United States Patent [19]

Sian et al.

[11] Patent Number: 4,602,837

[45] Date of Patent: Jul. 29, 1986

[54] DIMINUTIVE ELECTRICAL CONNECTOR

[75] Inventors: Sucha S. Sian, Southfield; Farhad Parvinpour, Sterling Heights, both of Mich.

[73] Assignee: United Technologies Automotive, Inc., Dearborn, Mich.

[21] Appl. No.: 566,000

[22] Filed: Dec. 27, 1983

[51] Int. Cl.[4] ..... H01R 11/00

[52] U.S. Cl. ..... 339/59 M; 339/176 M

[58] Field of Search ..... 339/59 M, 59 R, 176 MP

[56] References Cited

U.S. PATENT DOCUMENTS 3,686,619 8/1972 McCardell, Jr. et al. ..... 339/59 M 4,343,523 8/1982 Cairns et al. ..... 339/59 M

*Primary Examiner*—Gil Weidenfeld

*Assistant Examiner*—Paula A. Austin

*Attorney, Agent, or Firm*—Stephen A. Schneeberger

[57] ABSTRACT

A construction for a diminutive electrical connector, especially of the type having female-type terminals, includes a connector body for supporting the terminals and a locking block structured to aid in retaining the terminals in the connector body and to provide a closure for openings or "windows" which would otherwise exist adjacent to the mating ends of the terminals. The connector body may also be provided with a lip which serves as a partial closure. Small openings through the closure provide access to the female terminals by male terminals, and are contoured to aid in guiding the relative insertion of the latter into the former.

10 Claims, 13 Drawing Figures

DIMINUTIVE ELECTRICAL CONNECTOR

DESCRIPTION

1. Technical Field

The invention relates to electrical connectors and more particularly to diminutive electrical connectors. More particularly still, the invention relates to improved diminutive electrical connectors of the type in which the connector body includes a resilient arm with terminal-locking projection and a separate locking member for maintaining the projection in terminal-locking engagement.

2. Background Art

It is conventional practice to support pin and socket terminals in a pair of connector bodies in such manner that joining of the bodies in end-to-end, relation, possibly with some overlap, effects automatic insertion of the pin terminal into the socket terminals. If the terminals are to fit together easily, thereby minimizing the possibility of damaging the terminals, the supporting members, or both, then the terminals must be supported in their respective body members in such manner as to be substantially perfectly aligned. In an effort to attain this end, numerous arrangements for aligning and locking terminals in their connector bodies have been developed. In one such type of connector, separate coined, metal detents are installed in the connector body for retaining the terminals in position; however, such detents will occasionally take a "set" and thus become functionally inoperative.

A connector which overcomes the aforementioned problem and enjoys considerable popularity is of the type in which the connector body is formed of a molded plastic material and includes an integral resilient arm having a terminal-locking projection thereon. A separate locking member is provided for installation in the connector body to maintain the projection on the resilient arm in locking engagement with the terminal. A good example of this type of connector configuration is disclosed in U.S. Pat. No. 3,686,619 for "Electrical Connector Construction" by McCardell et al and assigned to the same assignee as the present invention. It is this type of connector and terminal pin locking arrangement to which the present invention applies. Other patents which disclose similar or related electrical connector arrangements in which the terminal is held in position directly or indirectly by a plastic detenting member and a separate locking or securing element include U.S. Pat. Nos. 3,487,355; 3,601,760; 3,937,545 and 4,343,523, the latter differing somewhat in that it is an edge connector for a printed circuit board.

In addition to the aforementioned desirable characteristics in this type of pin and socket type connectors, there has also been an incentive to reduce the size of such connectors for various applications. For instance, the automotive industry uses this type of connector extensively, and with the increased use of electrical signal paths and/or the desire to decrease size and weight of elements in the automobile, have encouraged the development of smaller and more compact, diminutive connectors. Such connectors typically include a plurality of electrically conductive paths, ranging from as few as two, to as many as ten or twenty or even more. With such numbers of conductive paths and the desire to make the respective connector as small as possible, the center spacing between adjacent sockets or pins may be on the order of only several millimeters. Such close spacing of the terminals makes it difficult to mold a connector body having a series of resilient terminal-locking arms freely spaced from one another and yet to also provide separating or occluding walls within the connector body between those arms. This limitation arises because of the extremely small size of molding core elements that would be required to provide the relatively small or narrow spaces or voids between the resilient arm and successive occluding wall.

While the aforementioned limitation may be avoided by using larger core elements in the mold and thus obtaining larger cavities or spacings or openings within the connector body, such openings may in and of themselves create another problem, particularly if they exist in the female connector. Specifically, the existence of such openings laterally adjacent to the female connector socket and extending to the mating face of the connector create so-called "windows". The male terminal pins might then enter a window rather than the female socket terminal. This problem may arise even if the female and male connector bodies are relatively aligned, if a male terminal pin is slightly deformed or skewed. In the event a terminal pin does enter or is deflected into a window rather than the female terminal, the terminal may be damaged and/or the desired electrical connection may be imperfect or nonexistent.

DISCLOSURE OF INVENTION

Accordingly, it is a principal object of the present invention to provide an improved construction for a diminutive electrical connector which ensures reliability and integrity in the electrical connection between the male and female halves of a connector pair.

It is a further object of the present invention to provide an improved diminutive electrical connector construction which facilitates the introduction of the terminal pins to the socket terminals.

It is yet a further object of the present invention to provide such an improved diminutive electrical connector construction which is relatively easy to manufacture and is functional and durable.

According to the invention there is provided an improved diminutive electrical connector construction for supporting a terminal, particularly a female-type terminal, having between its ends a recess and including a body having an opening therein for the accommodation of the terminal. One side of the opening is constituted by a resilient arm having a projection thereon extending inwardly of the opening a distance to be received in the recess of the terminal when the latter is accommodated in the body opening. The body opening which accommodates the terminal is part of a larger cavity in the body and into which the resilient arm extends. The cavity in the connector body is laterally adjacent to the resilient arm and the terminal and extends forwardly to the mating surface of the connector body and is relatively extensive such that a relatively large window is formed laterally adjacent to the terminal. A locking member is carried by the connector body in a position to prevent movement of the projection in a direction outwardly of the body opening. In accordance with the invention, the locking member includes a first portion which extends along each resilient arm in proximity therewith to provide the requisite prevention of movement of the projection and it includes a second flange-type portion configured to provide a closure near the mating face of the connector body for the window adjacent the terminal. The front surface of the locking means flange is substantially at or forward of the front end of the terminal.

The connector typically includes a plurality of female terminals arrayed side-by-side in a row in closely spaced relation and extending into the body cavity. The locking member may additionally include ribs extending rearwardly from its flange portion and positioned in the spaces between adjacent terminals to maintain their separation. The connector body is provided with a lip at its forward mating surface which extends upwardly across its width such that it defines a partial closure for the window adjacent each terminal. The connector body lip and the lock member flange are configured to have respective abutting edges which extend substantially along a line which intersects the centerlines of the side-by-side arrayed terminals. The abutting edges of the body lip and the locking member flange each include complemental openings therethrough for complementally defining respective openings in registry with the respective terminals for affording passsage of a male terminal therethrough. Each opening defined by the complemental openings in the edges of the abutting lock member flange and body lip include a boundary surface which is inclined inwardly in the rearward direction for guiding the male terminal into alignment with the female terminal.

BEST MODE FOR CARRYING OUT THE INVENTION

Figure 1:
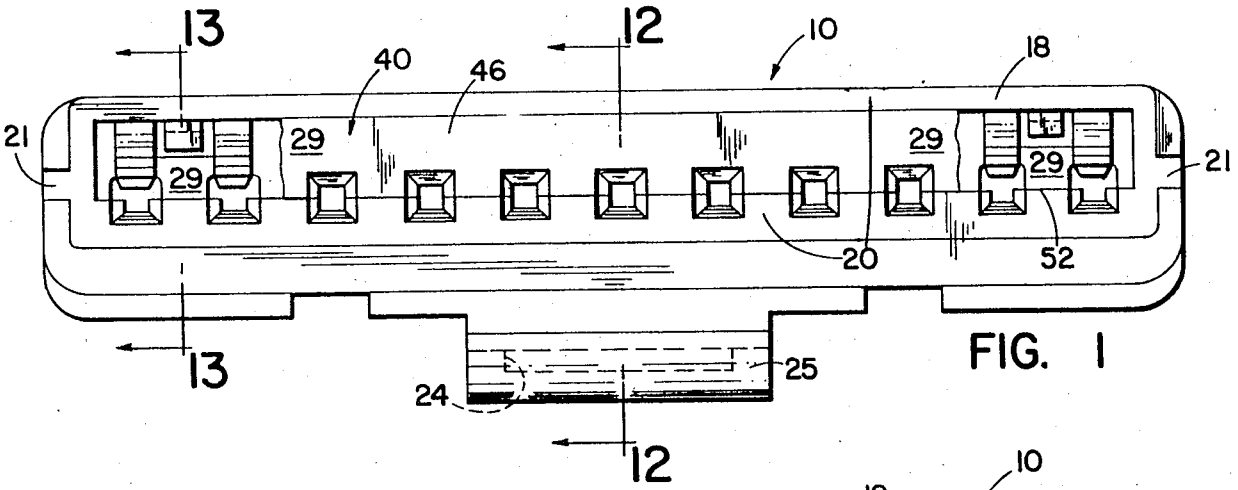
FIG. 1 is a front view of a female connector showing the locking member partly broken away.
Figure 2:
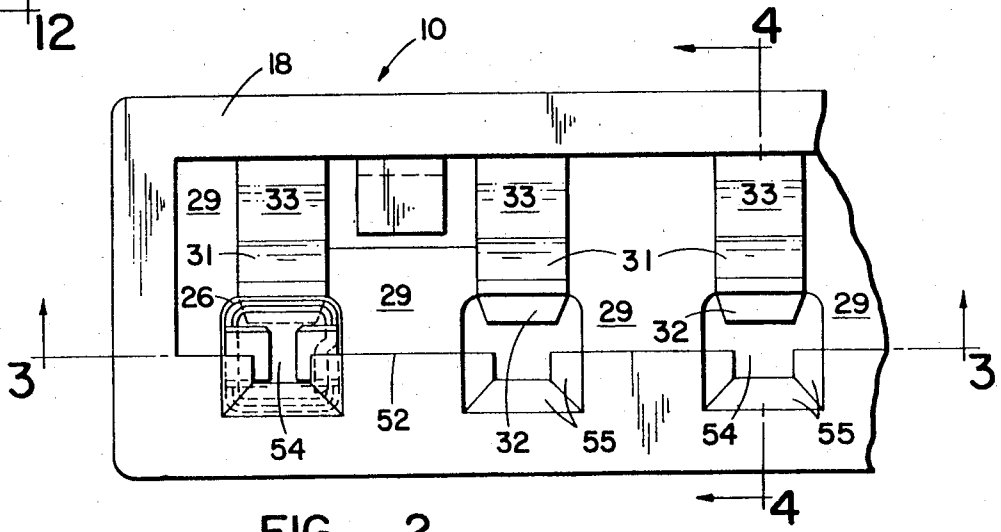
FIG. 2 is an enlarged view of the left-hand end of the connector in FIG. 1 and also depicting a socket terminal.
Figure 3:
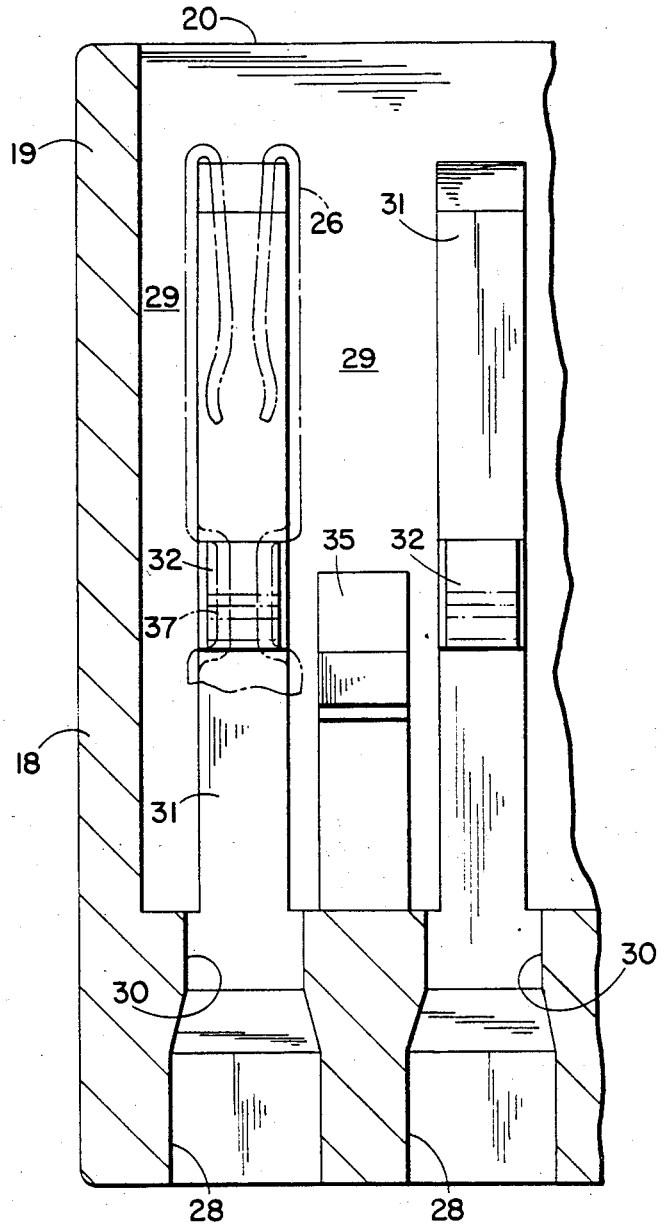
FIG. 3 is a sectional view of a part of the connector taken along line 3—3 of FIG. 2.
Figure 4:
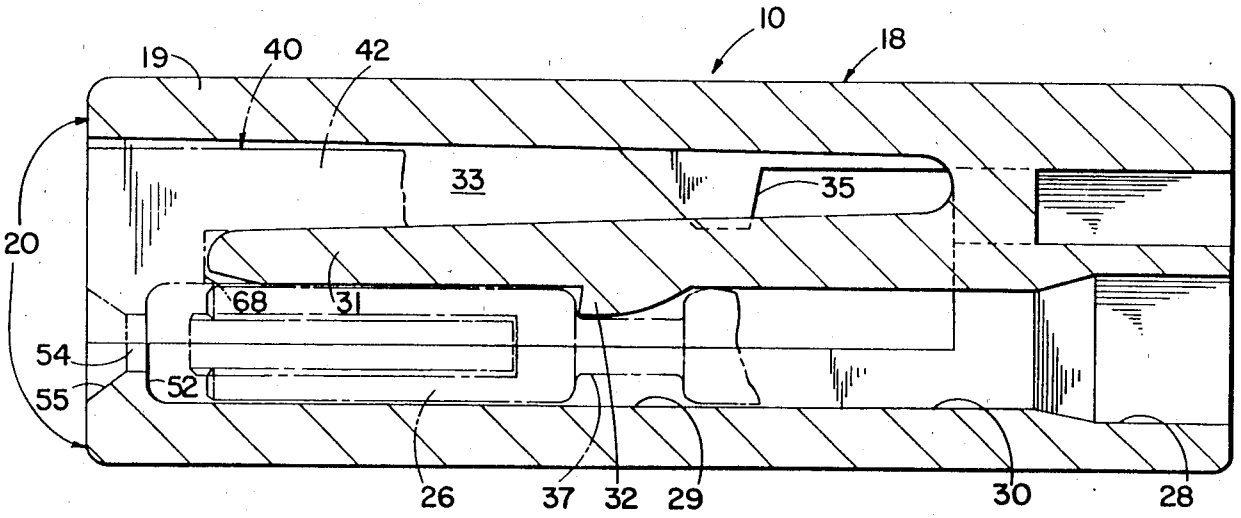
FIG. 4 is a sectional view of a part of the connector taken along line 4—4 of FIG. 2.
Figure 5:
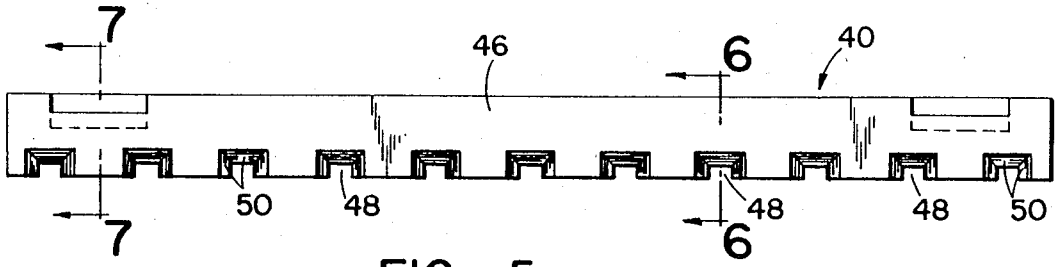
FIG. 5 is a front view of the locking member of the invention.
Figure 6:
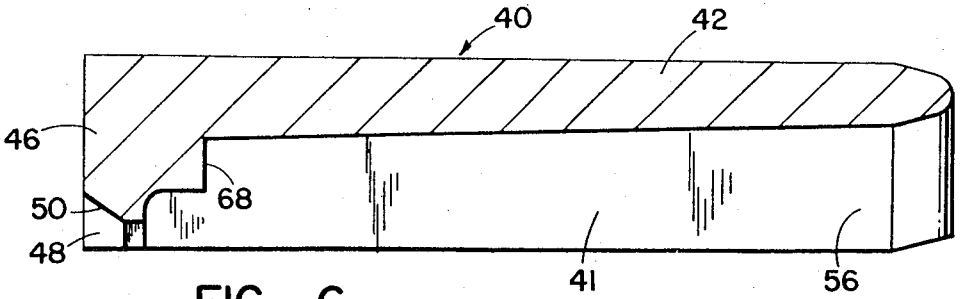
FIG. 6 is a sectional view of the locking member taken along line 6—6 of FIG. 5.
Figure 7:
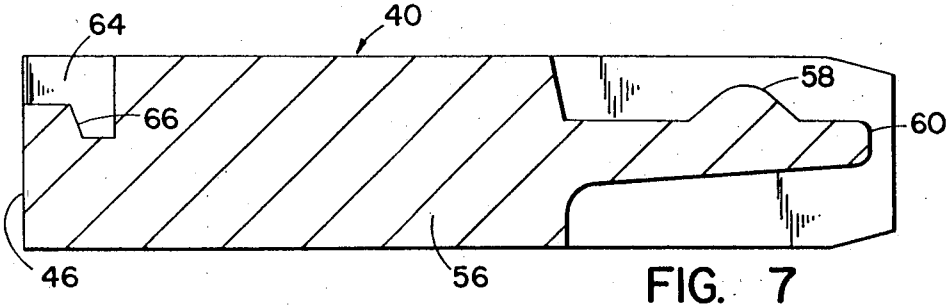
FIG. 7 is a sectional view of the locking member taken along line 7—7 of FIG. 5.
Figure 10:
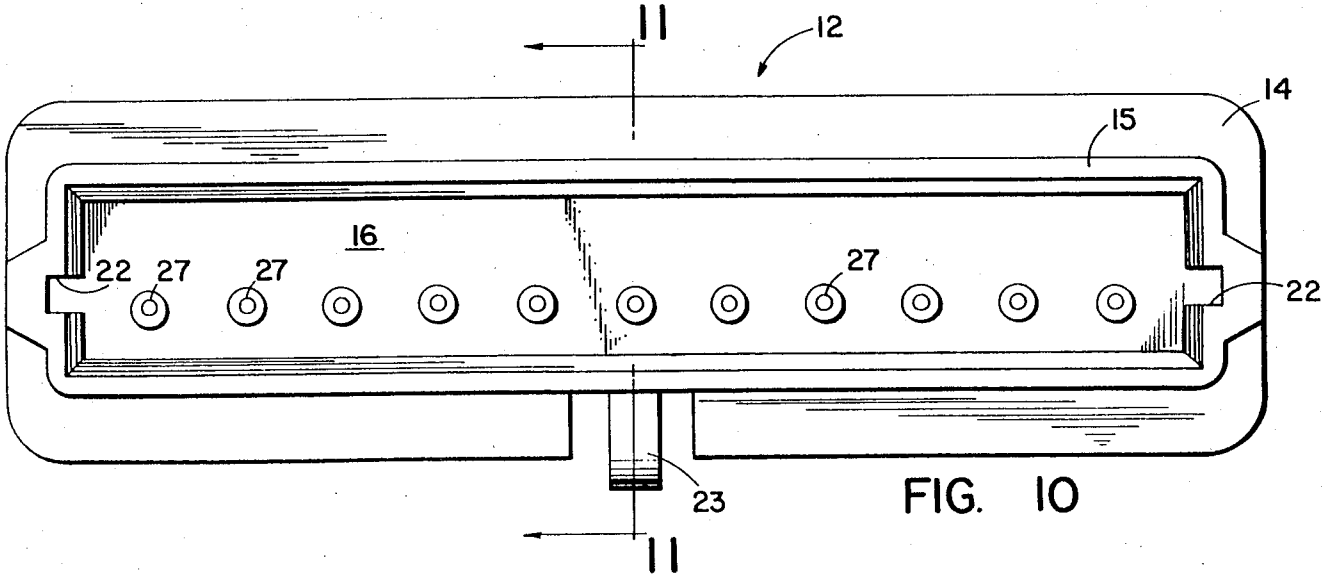
FIG. 10 is a front view of a male connector suitable for connection with the female connector of FIG. 1.
Figure 11:
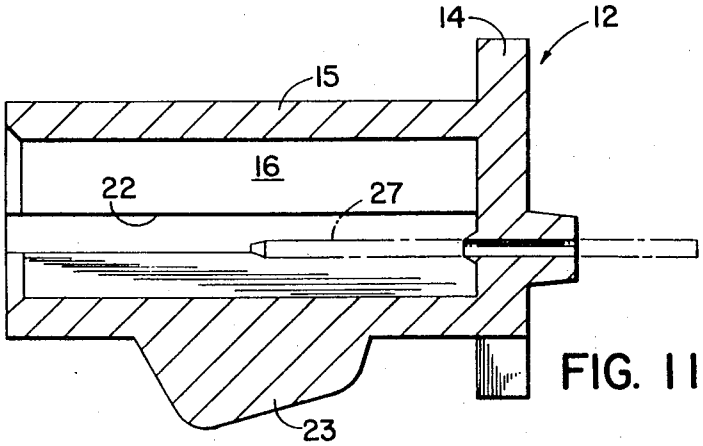
FIG. 11 is a sectional view of the male connector taken along line 11—11 of FIG. 10.

A diminutive electrical connector constructed in accordance with the invention is illustrated in the embodiment of the female connector 10 of FIG. 1 and other figures. A male connector 12 suitable for operative connection with the female connector 10 is illustrated in FIGS. 10 and 11 and in broken line in FIG. 12. The pair of connectors 10 and 12 are molded and formed of a resilient, electrically insulating material such as nylon or the like and are adapted to be assembled with one another in end-to-end relation. Such end to end relation may include some telescoping overlapping of the male and female connector body parts.

The male connector 12 comprises a body 14 having a skirt 15 at its forward end which surrounds a chamber 16. The female connector 10 comprises a body 18 having a forward end portion 19 of such size as to fit snuggly within the chamber 16 of male connector 12. The forwardmost region of the forward end portion 19 of connector 10 will be hereinafter referred to as the mating face 20 thereof. The body 18 of connector 10 has a pair of ribs 21 adapted to be accommodated in aligning grooves 22 provided in the skirt 15 of connector 12 for the reception of the ribs 21 so as to facilitate the proper joining of the connectors 10 and 12. The skirt 15 of connector 12 is provided with a keeper rib 23 on its underside for releasably fitting into a longitudinally extending slot 24 formed in a keeper flange 25 depending from and extending forwardly beneath the undersurface of the body 18 of connector 10 so as to releasably lock the connectors 10 and 12 in assembled relation. Alternatively, the bodies may be locked in assembled relation in any conventional manner.

The connectors 10 and 12 are of the pin and socket type, with connector 10 being provided with a plurality (in this instance 11) of female-type socket terminals 26 and the connector 12 being provided with a corresponding number of male-type pin terminals 27. The pin terminals 27 are typically of circular cross section and the socket terminals 26 may similarly be of circular cross section or, as in the illustrated embodiment, may be of rectilinear cross section. In the illustrated embodiment, the pin terminals 27 are rigidly molded into the body 14 of connector 12, however, it will be appreciated that other mounting configurations might be employed for that connector.

Referring now in greater detail to the female connector 10 incorporating the improved construction of the invention, the body 18 has a row of parallel openings 28 extending forwardly from a large cavity 11 extending across the rear end thereof to a large common cavity 29 in the forward end of the body via a passage or opening 30. In the illustrated embodiment the connector 10 includes eleven such rear openings 28, arranged in alignment across the width of the connector and closely spaced on 4 millimeter, or preferably 2.5 millimeter centers. The cavity 29 occupies most of the forward end portion 19 of connector 10 such that the front mating face 20 of connector body 18 is substantially open.

The cavity 29 in connector body 18 extends most of the height and width of the connector and extends rearwardly thereinto from the mating surface a significant distance, as for instance, two-thirds of its depth. Extending forwardly into the cavity 29 from the body 18 are a series of resilient, deflectable arms 31, each being associated with a respective one of the rear openings 28 in the connector. More specifically, each resilient arm 31 forms an extension of the upper surface of the connecting passage 30 and includes a projection 32 extending downwardly from the undersurface of the arm between its ends which extends radially or laterally inwardly of the associated extension of the passage or opening 30. The forward surface of the projection 32 is substantially normal to the longitudinal extent of the arm 31 whereas the trailing or rearward surface of that projection is inclined. Each of the arms 31 has a similar projection 32 which extends into the associated extension of passage opening 30.

Each resilient arm 31 is relatively narrow, being only approximately the width of a corresponding socket-type terminal 26 which it overlies. Each resilient arm 31 is sufficiently thin in the vertical direction to provide the requisite degree of flexibility. Further, each resilient arm 31 is spaced downwardly from the connector body surface defining the top wall of cavity 29 to form therebetween a respective slot 33. Because adjacent arms 31 are relatively closely spaced, being less than about 2 millimeters between edges, and it would be difficult to provide an intermediate wall or blockage member, the entirety of that spacing remains void as part of the cavity 29. The two exceptions to the maintenance of a complete void between adjacent resilient arms 31 occur between the first two arms and the last two arms where respective detent projections 35 extend downwardly from the connector body surface defining the top wall of cavity 29 for a purpose to be hereinafter described.

Each socket terminal 26 has a tubular body of generally square cross section and is sized to accommodate snugly a respective pin terminal 27. The socket terminal 26 has a recess or neck 37 of reduced cross section between its ends. The shoulders in the periphery of the socket terminal 26 which form a recess 37 are relatively abrupt. The rearward end of the socket terminal 26 is fastened to an insulated conductive wire 38. The longitudinal positioning of the recess 37 in socket terminal 26 and the projection 32 on resilient arm 31 are such that the projection 32 will extend into the terminal recess 37 when the terminal is operatively positioned in the connector in respective openings 28, 30.

Each socket terminal 26 is installed in the connector body 18 in the manner generally described in the aforementioned U.S. Pat. No. 3,686,619. Specifically, the socket terminal is inserted forwardly through the rear opening 28 in body 18 and thence on through the passage opening 30. As the forward end of the terminal 26 engages the projection 32 on resilient arm 31, the arm will be deflected upwardly into the slot 33 so as to enable the projection 32 to move outwardly of the passage 30. As the terminal 26 continues to move through passage 30, the neck recess will reach the projection 32 whereupon the inherent resilience of the arm 31 will restore the latter, with a snap action which may be felt, to its normal, unstressed condition in which the projection 32 is accommodated in the neck recess 37. Because of the abrupt shoulders which form the recess 37 in terminal 26 and because of the relatively short longitudinal extent of that recess, the longitudinal positioning of the terminal is fixed by the projection 32. A large, generally rectangular, grommet 39 is housed in rear cavity 11 to seal the terminals 26 from the environment.

In order to ensure that the projections 32 on resilient arms 31 remain in detenting relationship with the recesses 37 in the respective terminals 26, a locking wedge or block 40 constructed in accordance with the invention is used to prevent outward deflection of the arms 31 and their projections 32. The locking block 42 is of a resilient, electrically insulating material, such as nylon or the like. The locking block 40, seen in FIGS. 5–9 as well as other figures, spans the width of cavity 29 in connector body 18. The locking block 40 is of generally rectilinear configuration and in addition to spanning the width of cavity 29, is of such depth as to extend from the mating face 20 inwardly to or nearly to the back limits of the cavity 29 and is of such vertical thickness as to extend from the top of the cavity 29 downwardly to a line formed by the centers of the socket terminals 26.

More specifically, referring to FIGS. 5–9, the locking block 40 is provided with a series of respective recesses 41 extending longitudinally in the undersurface thereof which accommodate the respective terminal 26 and associated resilient arm 31 therewithin below a resulting wedge-shaped portion 42. The recesses 41 extend forwardly in the the locking block 40 from the rear end thereof to a position near but spaced rearwardly from the front face of the locking block. The thickness of the resulting wedge-shaped portion 42 of block 40 is selected to be snuggly received within the slot 33 above a respective resilient arm 31 for retaining that arm and its projection 32 in detenting engagement with the terminal 26 in a known manner.

Importantly to the invention, the front or forward portions of the locking block 40 are further configured to provide a closure for so-called "windows" which otherwise might exist laterally adjacent to the socket terminals 26 as a result of the broad extent of cavity 29 particularly in the region between the mating-face ends of the terminals 26 and the connector's mating face 20 itself. Accordingly, the forward end of locking block 40 is configured to provide a closure flange 46 which is substantially continuous across the width of cavity 29 and from the centerline of the socket terminals 26 upward to the top of cavity 29. A series of small, longitudinally-extending openings 48 are formed along and extend through the lower edge of flange 46 to permit passage of the pin terminals 27 of the corresponding male connector 12 into the respective socket terminals 26. The surfaces 50 which extend rearwardly from the front surface of locking block 40 for defining the openings 48 are chamfered or inclined toward the centers of the respective socket terminals 26 to guide the pin terminals 27 into alignment with the centers of the socket terminals 26 during coupling of the connectors 10 and 12.

In the illustrated embodiment, an upwardly extending lip 52 extends across the forward end of connector body 18 of connector 10 to provide a limited closure member for the forward end of cavity 29 along the region below the line or plane formed by the centerlines of the respective socket terminals 26. A series of longitudinally extending openings 54 are formed along and extend through the upper edge of lip 52 in alignment with the openings 48 of the closure flange 48 of block 40. Similarly, the surfaces 55 extending rearward from the front face of the lip 52 which define the openings 54 are chamfered or inclined inwardly toward the centerline of the socket terminals 26 so as to be complemental with the chamfered surfaces 50 of the closure flange 46 and cooperate in guiding the insertion of pin terminals 27 into socket terminals 26.

It will be appreciated that the closure flange 46 of locking block 40 might be extended downwardly sufficiently to replace the need for lip 52 while retaining its function as a closure for "windows" which might otherwise exist. Correspondingly, it might also be possible to extend the lip 52 upwardly a sufficient distance to reduce the "window closing" function of the locking block 40. However, the described configuration of the preferred embodiment provides the advantages of being relatively easier to mold and also affords the mating face 20 of connector 10 with a desirable degree of rigidity and integrity.

Figure 8:
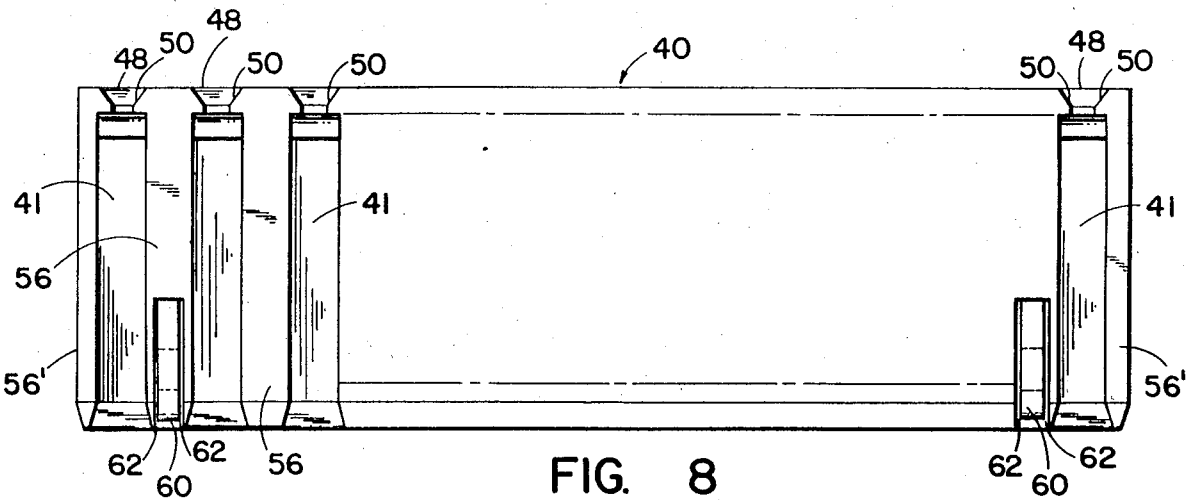
FIG. 8 is a bottom view of the locking member.
Figure 9:
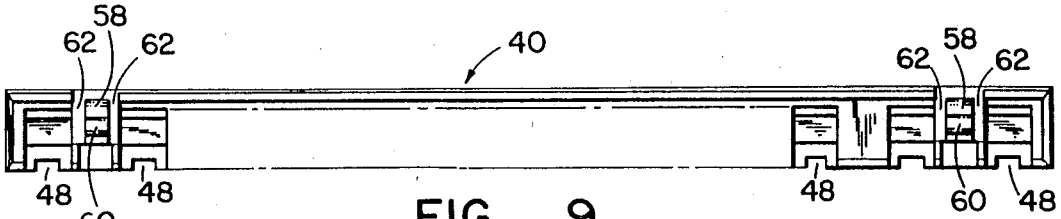
FIG. 9 is a rear view of the locking member.

Inasmuch as the recesses 41 on the underside of locking block 40 need only be the width of the resilient arms 31, the remaining distance between successive adjacent recesses 41, which may be one to several millimeters, comprise ribs 56 extending longitudinally rearward from the closure flange portions 46 at the front face of locking block 40. The ribs 56 serve to provide structural integrity to the combination of the female connector body 18 and locking block 40 and further serve to electrically isolate the socket terminals 26 from one another by providing extensions to the side walls of the terminal-housing passage 30. Similar ribs 56' also exist at the opposite ends of block 40, as seen in FIG. 8.

The locking block 40 is provided with a pair of resiliently supported, upwardly extending detenting tangs 58 for detented engagement with the projections 35 extending downwardly into the cavity 29 from the connector body 18. The detenting tangs 28 are supported on respective resilient fingers 60 formed by slots 62 extending forwardly into the rear face of locking block 40. A pair of slots 64 extending rearwardly and down into the locking block 40 at its upper corner and near its opposite ends define respective shoulders or surfaces 66 which may be engaged by a tool such as a screwdriver for removing the locking block from the connector body 18.

Assembly of the socket terminals 26 within connector body 18 is as previously described, with the individual terminals being inserted forwardly to the respective openings 28, 30 until they are latched in position by engagement of the respective projections 32 in the respective terminal recesses 37. Following insertion of all of the terminals 26, the locking block 40 is inserted into the front face of the cavity 29 in connector body 18 such that the wedge-shaped portions 42 of the block are snuggly received in the respective slots 33 above the resilient arms 31. The locking block 40 is inserted into connector body 18 until limited by engagement of the forward end of the respective resilient arms 31 with the rear-facing surfaces 68 formed by the recesses 41. The dimensioning of the connector body 18 and the locking block 40 is such that the front surface of the closure flange portion 46 of the locking block is at or preferably forwardly of the front end of the socket terminals 26. In this way, in addition to closing or occluding the "windows" which might otherwise exist laterally of the terminals 26, such closure is provided forwardly of the terminal ends and the inclinded surfaces 50, 56 may engage and guide the pin terminals before they arrive at the front end of the socket terminals 27.

Figure 12:
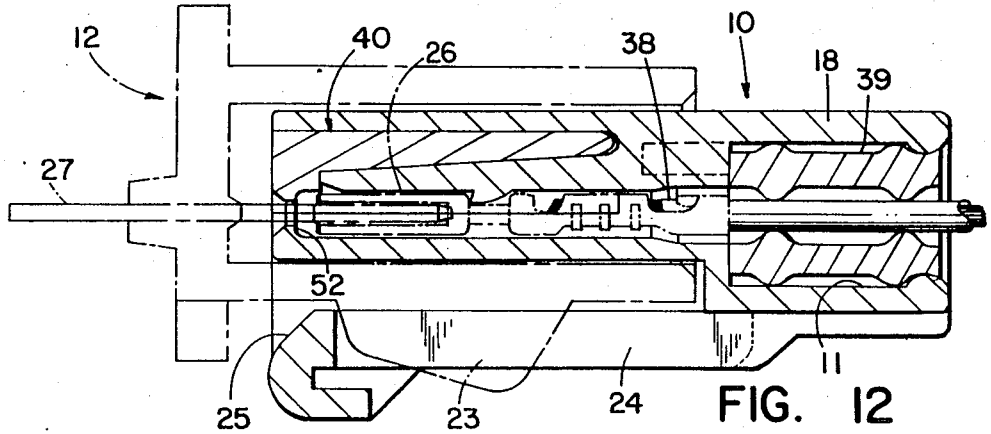
FIG. 12 is a sectional view of the female connector of FIG. 1 taken along line 12—12 thereof and additionally showing the male connector operatively coupled therewith.
Figure 13:
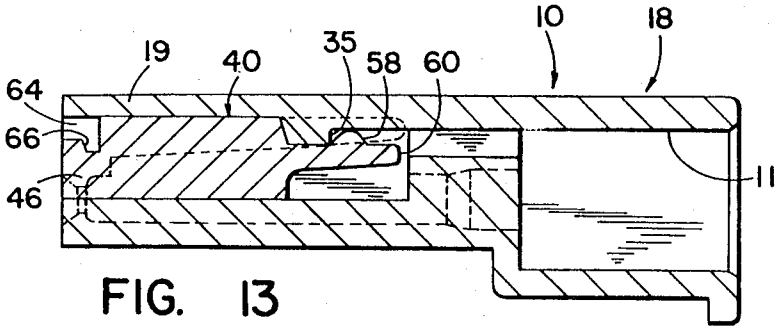
FIG. 13 is a sectional view of the connector of FIG. 1 taken along line 13—13 thereof.

The connectors 10 and 12 may be joined to one another in end-to-end relation by relatively inserting the forward end 19 of the body 18 into the chamber 16 of the body 14. As mentioned, the complemental chamfered surfaces 50, 56 of the terminal openings 48, 54 assist in aligning and guiding the pin terminals 27 relatively into the socket terminals 26. When such coupling is completed, the keeper rib 23 of connector 12 is retainedly captured in slot 24 of connector 10 to prevent their inadvertent uncoupling. FIG. 12 illustrates connectors 10 and 12 in fully coupled relationship. A gasket (not shown) may occupy the space between the mating face of connector 10 and the base of chamber 16 in connector 12.

Although this invention has been shown and described with respect to detailed embodiments thereof, it will be understood by those skilled in the art that various changes in form and detail thereof may be made without departing from the spirit and scope of the claimed invention.

Having thus described a typical embodiment of our invention, that which is claimed as new and desired to secure by Letters Patent of the United States is:

1. For use in a pin and socket type connector, a diminutive electrical connector construction of the socket type for supporting a female-type terminal having between its ends a recess, said construction including a body having an opening therein for the accommodation of said terminal, one side of said opening being constituted by a resilient arm having a projection thereon extending inwardly of said opening a distance to be received in said recess of said terminal when the latter is accommodated in said opening, said opening being part of a larger cavity in said body and into which said resilient arm extends, said cavity in said body being laterally adjacent to said resilient arm and to said terminal and extending forwardly to the mating face of said body and being relatively extensive such that a relatively large window is formed laterally adjacent to said terminal, said window adjacent to said terminal extending forwardly from said terminal to said mating face of said body, and locking means carried by said body in a position to prevent movement of said projection in a direction outwardly of said opening, said locking means comprising a first portion and a second portion, said first portion extending along said resilient arm in proximity therewith for said prevention of movement of said projection and said second portion comprising a flange configured to provide a closure near the mating face of said connector body for said window adjacent the terminal, the front surface of said locking means flange being substantially at or forwardly of the front end of said terminal, said locking means flange including an opening extending therethrough and being substantially aligned with a respective said female-type terminal to permit passage of a male terminal therethrough.

2. The construction of claim 1 wherein said locking means further includes a plurality of ribs extending rearwardly from said flange portion, a pair of said ribs extending longitudinally along opposite sides of each respective said resilient arm and terminal.

3. The construction of claim 1 wherein said connector body also includes a lip formed integrally therewith and oriented to form a closure at substantially the mating face of the connector body for thereby limiting the size of said window.

4. The construction of claim 3 wherein said locking means flange and said body lip complementally define a closure near the connector mating face which closes substantially the entire said window laterally adjacent to said terminal.

5. The construction of claim 4 wherein said locking means flange and said body lip abut one another along respective edges extending across the mating face of said body in line with a respective said terminal, said locking means flange opening being in said abutting edge thereof, and wherein said body lip includes an opening therethrough in said abutting edge thereof for complementally defining, with said locking means flange opening, an opening in registry with said terminal for affording passage of a male terminal therethrough.

6. The construction of claim 5 wherein said opening defined by said respective complemental openings in the edges of said locking means flange and said body lip includes a boundary surface inclined inwardly in the rearward direction thereby to guide an entering male terminal into alignment with the female terminal.

7. The construction of claim 6 wherein said connector supports a plurality of said terminals therein and said locking means flange provides a said window closure for each said terminal.

8. The construction of claim 7 wherein said locking means further includes a plurality of ribs extending rearwardly from said flange portion, a respective said rib extending rearwardly between each pair of adjacent said terminals to thereby aid in maintaining separation of said terminals.

9. The construction of claim 7 wherein said female terminals are arrayed side-by-side in a row in spaced relation, the spacing between centers of adjacent said female terminals being less than about 4 mm.

10. The construction of claim 9 wherein said spacing between adjacent terminals is about 2.5 mm.

* * * * *